US006910677B1

(12) United States Patent
Miller et al.

(10) Patent No.: US 6,910,677 B1
(45) Date of Patent: Jun. 28, 2005

(54) PORTABLE POWER JACK DEVICE

(76) Inventors: Terry R. Miller, 425 Oakville Rd., Shippensburg, PA (US) 17257; Patricia N. Miller, 425 Oakville Rd., Shippensburg, PA (US) 17257

( * ) Notice: Subject to any disclaimer, the term of this patent is extended or adjusted under 35 U.S.C. 154(b) by 63 days.

(21) Appl. No.: 10/445,444

(22) Filed: May 28, 2003

(51) Int. Cl.[7] ..... B66F 3/18

(52) U.S. Cl. ..... 254/126; 254/122; 254/103; 254/DIG. 1; 254/DIG. 2; 254/DIG. 3

(58) Field of Search ..... 254/122, 126, 254/DIG. 2, DIG. 1, DIG. 3, 98, 103, 124

(56) References Cited

U.S. PATENT DOCUMENTS 3,451,655 A * 6/1969 Scott ..... 254/126
3,623,707 A * 11/1971 Klopp ..... 254/122
4,653,727 A * 3/1987 Chang et al. ..... 254/126
4,943,034 A * 7/1990 Wagnon ..... 254/126
5,085,407 A * 2/1992 Lonon ..... 254/103

* cited by examiner

*Primary Examiner*—Robert C. Watson

(57) ABSTRACT

A battery driven reversible motor and speed reduction gear assembly coupled to a worm-screw scissor jack, all mounted on a flat, stable platform (base plate) for use in raising and lowering the corner of a vehicle. The device can be powered from a rechargeable battery pack or from the vehicle's battery. A controller unit extended by means of a cable is used to raise and lower the vehicle while the user stands out-of-the-way in safe location. The device also has a light for illuminating the work area for nighttime application. In use, the lift plate on top of the scissor-jack is placed under the frame or axle of the vehicle close to the flat tire and the power switch is turned ON. The user then walks away from the vehicle, with the controller unit in his/her hand, to a safe distance. The UP button on the controller unit is pressed to enable the motor and gear drive so that the drive shaft, which is coupled to the worn-screw of the scissor-jack, turns slowly lifting the corner of the vehicle up until the flat tire is off the ground. This process is reversed to lower the vehicle once the flat tire has been changed.

12 Claims, 3 Drawing Sheets

PORTABLE POWER JACK DEVICE

BACKGROUND OF THE INVENTION

1. Field of the Invention

The present invention relates to a jack for use in connection with raising and lowering a vehicle. The portable power jack device has particular utility in connection with quickly and safely raising a vehicle wheel off the ground to change a flat tire.

2. Description of the Prior Art

Anyone who has changed a flat tire knows the hassle and potential for serious injury involved with jacking up a car along the side of the road. There can be trouble in getting the jack assembled and in place under the vehicle's frame or axle, as well as the possibility of injuring the hands or fingers in operating the jack. Then there is the safety concern of the vehicle falling off the jack while the tire is being changed. Power driven jacks are desirable since they allow the person changing the tire to stand out-of-the-way of the vehicle while raising the tire off the ground and require very little physical exertion in raising or lower the vehicle.

The use of power jacks is known in the prior art. For example, U.S. Pat. No. 4,872,230 to Levine discloses an electrically powered automobile jack and nut remover that is powered from an automobile battery. However, although the Levine '230 patent discloses a device that is similar in function, the structure has distinctive differences from that of the present invention. For example, the Levine '230 patent does not disclose a unit positioned on a flat stable platform for providing a safer working environment.

U.S. Pat. No. 6,299,138 to Huang et al. discloses a direct drive electromotive jack device for releasing torsional force that can be use to raise and lower a motor vehicle. However, although the Huang '138 patent, like the Levine '230 patent, discloses a device that is similar in function, it is distinctively different in structure from that of the present invention and in particular does not disclose a unit positioned on a flat stable platform for providing a safer working environment.

Similarly, U.S. Pat. No. 5,657,964 to Yoshida discloses an electric power tool for driving a jack. This electric drive unit can be used with available scissor-jacks for raising and lowering an object, such as an automobile. However, the Yoshida '964 patent discloses a device that is different in structure from that the Levine '230 patent, and does not disclose a contained portable unit, including a jack, positioned on a flat stable platform for providing a safer working environment, but only the electrical drive portion of the unit.

Also, U.S. Pat. No. 6,029,950 to Yeh discloses a jack assembly with a gear box drive for use in raising and lowering an object, such as an automobile. The device can be coupled to a power unit or driven manually. However, the Yeh '950 patent discloses a device that is different in structure from that of the present unit, and does not disclose a contained portable unit, including a drive motor, positioned on a flat stable platform for providing a safer working environment, but only scissor jack with gear box portion of the unit.

Lastly, U.S. Pat. No. 3,977,278 to Jackson discloses apparatus that may be of general interest and pertinent to the construction and design of the present invention. The Jackson '278 patent discloses an automotive electric impact wrench that has electrical, rotational, and portable characteristics similar to that of the apparatus of the present invention. However, the Jackson '278 patent is different in both function and structure from that of the present invention and does not does not disclose a portable automotive power jack with all the components positioned on a flat stable platform for providing a safer working environment.

While the above-described devices fulfill their respective, particular objectives and requirements, the aforementioned patents do not describe a portable contained power jack device that allows the quick and safe raising and lowering of a vehicle while standing at a safe distance.

Therefore, a need exists for a new and improved portable power jack device that can be used for raising and lowering an object while standing at a safe distance from the object. In this regard, the present invention substantially fulfills this need. In this respect, the portable power jack device according to the present invention substantially departs from the conventional concepts and designs of the prior art, and in doing so provides an apparatus primarily developed for the purpose of providing a fast, safe, and convenient device for raising and lowering an object, such as an automobile.

SUMMARY OF THE INVENTION

In view of the foregoing disadvantages inherent in the known types of power jacks now present in the prior art, the present invention provides an improved portable power jack device, and overcomes the above-mentioned disadvantages and drawbacks of the prior art. As such, the general purpose of the present invention, which will be described subsequently in greater detail, is to provide a new and improved portable power jack device and method that has all the advantages of the prior art mentioned heretofore and other novel features that result in a portable power jack device that is not anticipated, rendered obvious, suggested, or even implied by the prior art, either alone or in any combination thereof.

The device of the present invention will allow the corner of a vehicle to be quickly and safely raised without a manual struggle so a flat tire can be changed. This motorized jack will be particularly useful to female and elderly motorist who may have difficulty operating a typical manual jack, as well as do-it-yourselfers who rotate tires, perform brake service, and apply tire chains. Other attractions of this device include ease of use, safety, convenience, and speeding up the job of changing a flat tire.

To attain this, the present invention essentially comprises a battery driven reversible motor and speed reduction gear assembly coupled to a worm-screw scissor jack, all mounted on a flat, stable platform (base plate). The device can be powered from a rechargeable battery or from a vehicle's battery. A controller unit extended by means of a cable is used to raise and lower the vehicle while the user stands out-of-the-way in a safe location. The device also has a light for illuminating the work area for nighttime application.

In use, it can now be understood that the lift plate on top of the scissor-jack is placed under the frame or axle of a vehicle close to the flat tire, the power switch is turned ON, and the user walks away to a safe distance from the vehicle with the controller unit in his/her hand. The UP button on the controller unit is then pressed to enable the motor and speed reduction gear, which is coupled to the worn-screw of the scissor-jack, to turn slowly, thereby lifting the corner of the vehicle up until the flat tire is off the ground. The flat base plate provides a stable support under the frame or axle while the tire is being changed. Once the tire is changed, the user once again moves away from the vehicle and presses the DOWN button on the controller unit until the tire is back solid on the ground. The power switch is then turned OFF and the device is removed from underneath the vehicle. If conditions warrant, the work area can be illuminated with the light, which is turned ON and OFF with the light switch.

There has thus been outlined, rather broadly, the more important features of the invention in order that the detailed description thereof that follows may be better understood and in order that the present contribution to the art may be better appreciated.

There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved portable power jack device that provides in the apparatuses and methods of the prior art some of the advantages thereof, while simultaneously overcoming some of the disadvantages normally associated therewith.

It is another object of the present invention to provide a new and improved portable power jack device that may be easily and efficiently manufactured and marketed.

An even further object of the present invention is to provide a new and improved portable powerjack device that has a low cost of manufacture with regard to both materials and labor, and which accordingly is then susceptible of low prices of sale to the consuming public, thereby making such power jacks economically available to the buying public.

Lastly, it is an object of the present invention to provide a new and improved method for quickly and safely raising and lowering a vehicle wheel off the ground to change a flat tire.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
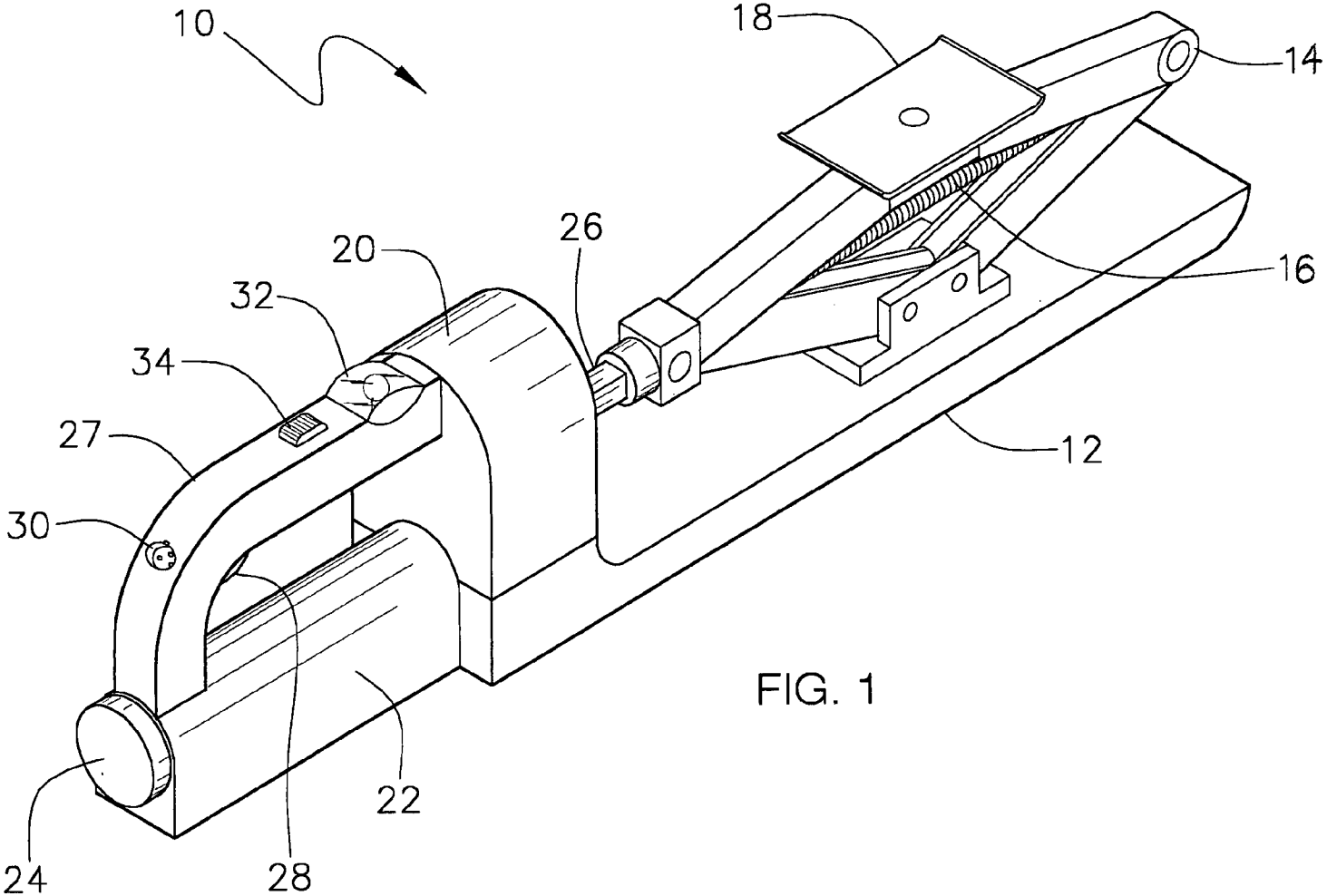
FIG. 1 is a perspective view of the preferred embodiment of the portable power jack device constructed in accordance with the principles of the present invention.

Referring now to the drawings, and particularly to FIGS. 1–5, a preferred embodiment of the portable power jack device of the present invention is shown and generally designated by the reference numeral 10.

Figure 3:
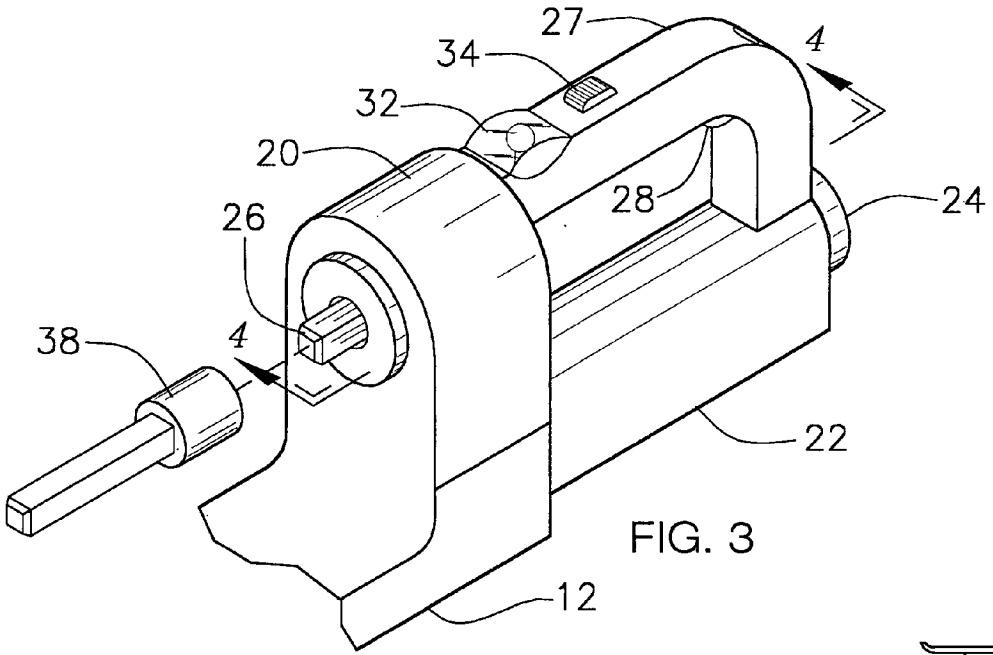
FIG. 3 is a perspective view of the power drive end of the portable power jack device of the present invention.
Figure 2:
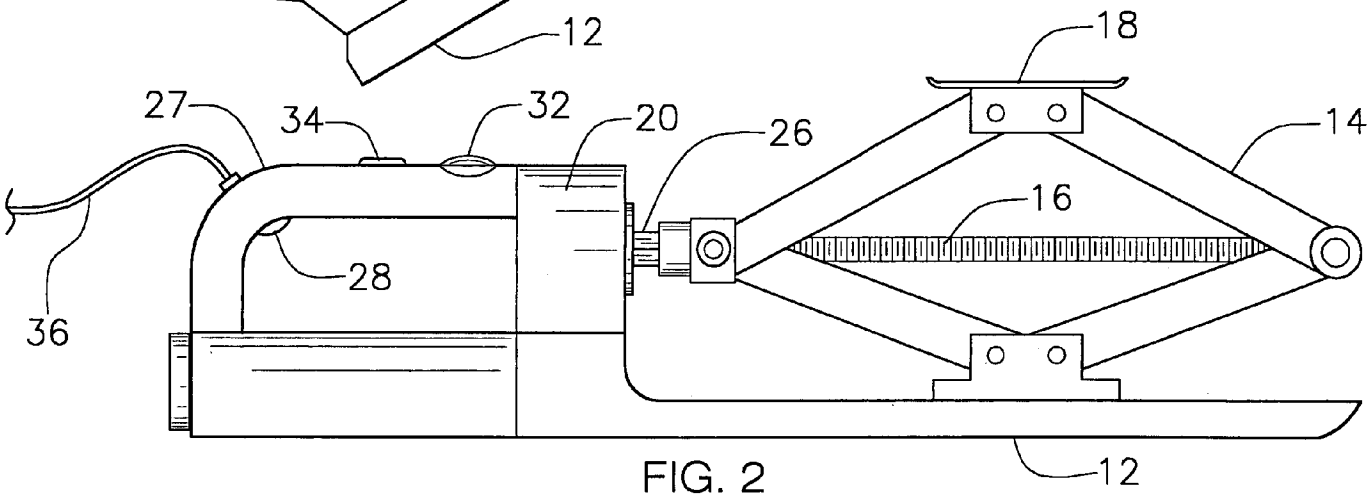
FIG. 2 is a side view of the power drive end of the portable power jack device of the present invention.

In FIGS. 1, 2, and 3 the new and improved portable power jack device 10 of the preferred embodiment of the present invention, which provides a fast, safe, and convenient device for raising and lowering an object, is illustrated and described in an overall perspective view, a side view, and a perspective view of the power drive end of the device, respectively. More particularly, the portable power jack device 10 comprises a solid metal base plate 12, having a flat stable bottom surface for contact with the ground, a scissor-jack 14 mounted at one end and a motor/gear assembly, enclosed in a housing 20, mounted at the opposite end with the drive shaft 26 of the gear assembly being coupled by coupler 38 means to the input coupler of said scissor-jack 14. The scissor-jack operational mechanism uses a worm screw 16 to raise and lower a flat lift plate 18 that supports the frame or axle of a vehicle. A battery housing 22 with removable end cap 24 is mounted adjacent to the motor/gear housing 20 for containing rechargeable batteries for supplying power to the motor. A handle 27 is provided for convenience in handling and carrying the power jack device. Built into the handle 27 in a user-friendly location are an ON/OFF switch 28, a light 32 and light switch 34 for illuminating the work area, and a controller unit receptacle 30 for interfacing with the cable 36 from a controller unit.

Figure 4:
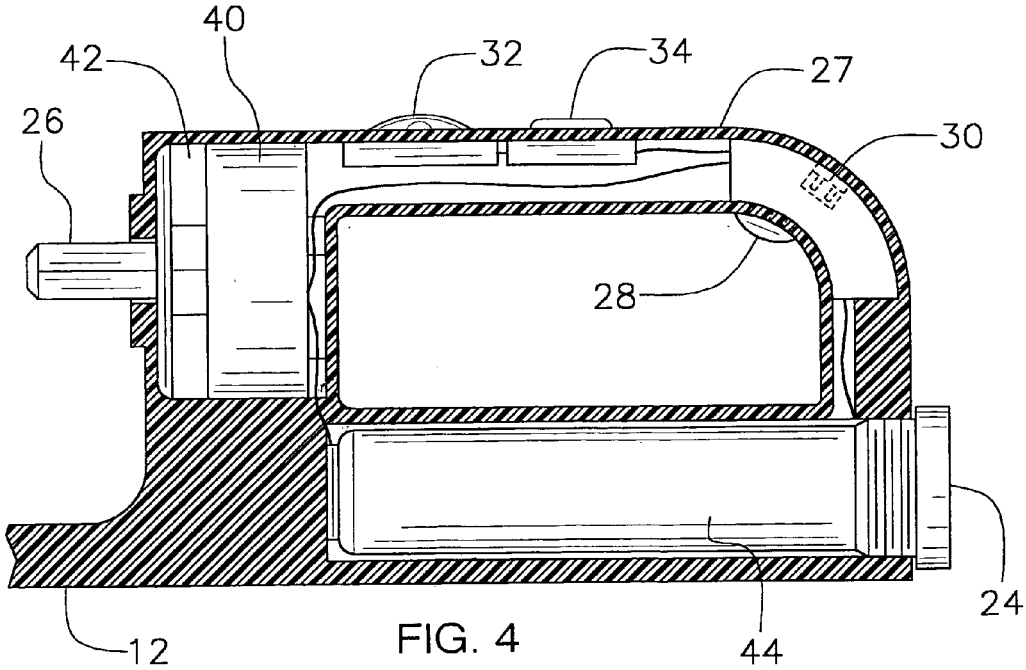
FIG. 4 is a cross-sectional side view of the power drive end of the portable power jack device of the present invention.

FIG. 4 is a cross-sectional side view of the power drive end of the portable power jack device of the present invention showing more details of the power unit portion of the device. More particularly, this shows the reversible motor 40 coupled to the speed reduction gears 42, with output drive shaft 26. The drawing also better illustrates the user-friendly locations of the ON/OFF switch 28, the controller unit receptacle 30, the light 32, and light switch 34. A rechargeable battery pack 44 is installed in the battery housing 22 and contained by an end cap 24.

Figure 5:
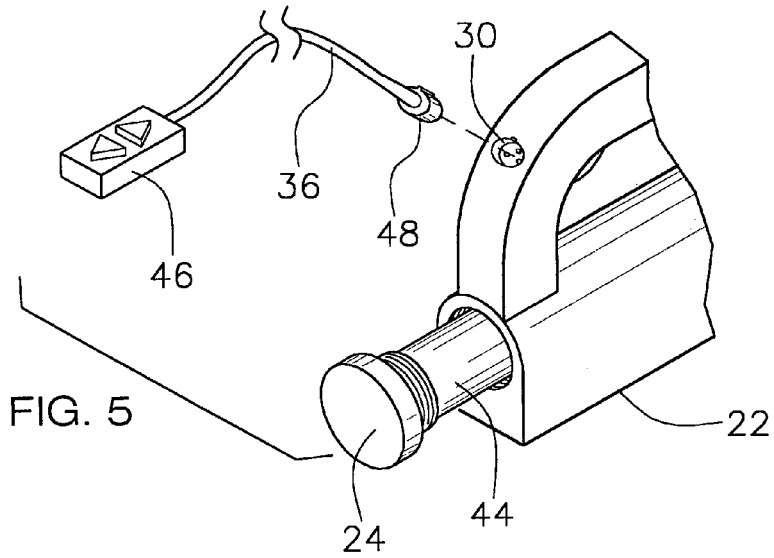
FIG. 5 is a perspective view showing the controller unit and battery pack of the portable power jack device of the present invention.

Finally, FIG. 5 is a perspective view showing the controller unit 46 and battery pack 44 of the portable power jack device 10 of the present invention. The controller unit 46 has a cable 36 with a cable connector 48 mounted on the end for interfacing with the controller unit receptacle 30 on the handle 27 of the device. The controller unit cable 36 is at least 10-feet long to allow a user of the portable power jack device to stand at a safe distance when raising and lowering a vehicle. Also, the battery pack 44 is inserted into the battery cavity and contained in place by means of the end cap 24 being screwed into provided threads in the battery housing 22.

In use, it can now be understood that the lift plate 18 on top of the scissor-jack 14 is placed under the frame or axle of a vehicle close to the flat tire and the user walks away to a safe distance from the vehicle with the controller unit 46 in his/her hand. The power switch 28 is turned ON and the UP button on the controller unit 46 is pressed to enable the motor 40 and speed reduction gear 42, which is coupled to the worn-screw 16 of the scissor-jack 14, to turn slowly, thereby lifting the corner of the vehicle up until the flat tire is off the ground. The flat base plate 12 provides a stable support under the frame or axle while the tire is being changed. Once the tire is changed, the user once again moves away from the vehicle and presses the DOWN button on the controller unit 46 until the tires is back solid on the ground. The power switch 28 is then turned OFF and the device is removed from underneath the vehicle. If conditions warrant, the work area can be illuminated with the light 32, which is turned ON and OFF by means of the light switch 34.

While a preferred embodiment of the portable power jack device has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, the power jack device can be made in various sizes for use with compact cars, large cars and pickup trucks, and large trucks. Optionally, the power jack device can be powered from a vehicle battery by means of connecting batteries cables to the battery.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A power jack device, comprising:

a base plate;

a reversible motor mounted at one end of said base plate;

a speed reduction gear means coupled to the shaft of said reversible motor;

a motor/gear housing attached to said base plate for covering said reversible motor and said speed reduction gear means;

a scissor-jack means mounted at the opposite end of said base plate for raising and lowering a vehicle, the input drive coupler of said scissor-jack means being coupled to the output of said speed reduction gear means;

a rechargeable battery contained in a battery housing attached to said base plate adjacent said motor/gear housing, for supplying power to said motor;

a formed handle mounted to the motor end of said device;

a controller unit removably coupled by cable means to a receptacle mounted on said device for controlling the raising and lowering of said device;

an ON/OFF switch mounted on said handle for applying electrical power to said reversible motor;

a light mounted on top of said handle for illuminating a work area; and a light switch mounted on said handle for turning said light ON and OFF.

2. The device of claim 1, wherein said base plate has a flat bottom surface for making stable contact with the ground.

3. The device of claim 1, wherein said base plate is fabricated from material from the group comprised of: steel, aluminum, brass, and molded polyester.

4. The device of claim 1, said scissor-jack means further comprising a worm screw means for raising and lowering said lift plate.

5. The device of claim 1, wherein said scissor-jack means has a flat lift plate attached at the top surface for interfacing with a vehicle frame or axle.

6. The device of claim 1, wherein said battery housing has a removable end cap for supplying a battery pack to said device.

7. The device of claim 1, wherein the cable of said controller unit is at least 10-feet long, thereby providing a safe operating distance when raising and lowering said vehicle.

8. The device of claim 1, said controller unit further comprising:

an up button for raising said vehicle; and a down button for lowering said vehicle.

9. The device of claim 1, wherein power is supplied to said power jack device from the vehicle battery by battery-cable means.

10. A method for safely raising a vehicle wheel off the ground to change a flat tire, comprising the steps of:

providing a portable powerjack device, said power jack device further comprising:

a base plate;

a reversible motor mounted at one end of said base plate;

a speed reduction gear means coupled to the shaft of said reversible motor;

a motor/gear housing attached to said base plate for covering said reversible motor and said speed reduction gear means;

a scissor-jack means mounted at the opposite end of said base plate for raising and lowering a vehicle, the input drive coupler of said scissor-jack means being coupled to the output of said speed reduction gear means;

a rechargeable battery contained in a battery housing attached to said base plate adjacent said motor/gear housing, for supplying power to said motor;

a formed handle mounted to the motor end of said device;

a controller unit removably coupled by cable means to a receptacle mounted on said device for controlling the raising and lowering of said device;

an ON/OFF switch mounted on said handle for applying electrical power to said reversible motor;

a light mounted on top of said handle for illuminating a work area; and a light switch mounted on said handle for turning said light ON and OFF;

attaching said controller unit by said cable means to said power jack device;

turning said ON/OFF switch to ON position;

turning on said light on said power jack device as needed;

placing said scissor-jack under the frame or axle of a vehicle near the wheel needing assistance;

walking a safe distance from said vehicle while holding said controller unit in the hand;

pressing said UP button on said controller unit until the flat tire of said vehicle is off the ground;

changing said flat tire;

walking a safe distance from said vehicle while holding said controller unit in the hand;

pressing the DOWN button on said controller unit until the replaced tire of said vehicle is back on the ground;

removing said power jack device from underneath said vehicle;

turning OFF said light; and turning said ON/OFF switch to OFF position.

11. A portable power jack device for raising and lowering one corner of a vehicle, comprising:

a metal base plate, said base plate having a flat bottom surface for making stable contact with the ground;

a reversible motor mounted at one end of said base plate;

a speed reduction gear means coupled to the shaft of said reversible motor;

a motor/gear housing attached to said base plate for covering said reversible motor and said speed reduction gear means;

a scissor-jack mounted at the opposite end of said base plate, said scissor-jack having a worm screw means for raising and lowering said lift plate, said worm screw means being coupled to the output of said speed reduction gear means, said scissor-jack further having a flat lift plate attached at the top surface for interfacing with a vehicle frame or axle;

a rechargeable battery contained in a battery housing attached to said base plate adjacent said motor/gear housing for supplying power to said motor, said battery housing having a removable end cap for supplying a battery pack to said device;

a formed handle mounted to the motor end of said device;

a controller unit removably coupled by cable means to a receptacle mounted on said device, said controller unit having UP and DOWN buttons for use in raising and lowering said device, said cable means being at least 10-feet in length for providing a safe operating distance when raising and lowering said vehicle;

an ON/OFF switch mounted on said handle for applying electrical power to said reversible motor;

a light mounted on top of said handle for illuminating a work area; and a light switch mounted on said handle for turning said light ON and OFF.

12. The device of claim 11, wherein power is supplied to said power jack device from the vehicle battery by battery-cable means.

* * * * *